United States Patent [19]

Grimley

[11] 4,079,999

[45] Mar. 21, 1978

[54] METHOD AND APPARATUS FOR MINING

[75] Inventor: Arthur W. T. Grimley, Fernie, Canada

[73] Assignee: Kaiser Resources Ltd., Vancouver, Canada

[21] Appl. No.: 773,158

[22] Filed: Mar. 1, 1977

Related U.S. Application Data

[63] Continuation of Ser. No. 597,985, Jul. 22, 1975, abandoned.

[30] Foreign Application Priority Data

Oct. 25, 1974 Canada ..... 212253

[51] Int. Cl.[2] ..... E21C 41/00

[52] U.S. Cl. ..... 299/17; 299/18; 299/19

[58] Field of Search ..... 299/17, 18, 19

[56] References Cited

U.S. PATENT DOCUMENTS

| | | | |
|---|---|---|---|
| 878,208 | 2/1908 | Kirschniok | 299/17 |
| 1,428,728 | 9/1922 | Weber | 299/18 X |
| 3,260,548 | 7/1966 | Richl | 299/18 |
| 3,306,665 | 2/1967 | Lobbe | 299/17 X |
| 3,744,847 | 7/1973 | Messer | 299/17 X |
| 3,790,214 | 2/1974 | Kilroy | 299/18 X |
| 3,900,226 | 8/1975 | de Jong | 299/18 X |

*Primary Examiner*—Ernest R. Purser
*Assistant Examiner*—William F. Pate, III

[57] ABSTRACT

The invention relates to a method and apparatus for hydraulically mining friable carbonaceous material such as coal or other suitable materials wherein a feeder/-breaker is placed in the entry with complete mining facilities mounted on this second machine including hydraulic monitors, one for cutting material from a seam or panel and, if desired, a second monitor for breaking and flushing the mined material in the form of a slurry for transport through the machine where it is mechanically broken and crushed to predetermined size and the solids/water slurry discharged into a flume for transport from the mine.

10 Claims, 7 Drawing Figures

METHOD AND APPARATUS FOR MINING

This is a continuation of application Ser. No. 597,985, filed July 22, 1975 now abandoned.

BACKGROUND OF THE INVENTION:

One of the most significant breakthroughs in hydraulically mining coal or the like has been the recent proposal to provide a feeder/breaker machine in the entry of a coal mine in cooperative relation with a monitor which functions to cut and break the coal. In this improved system, as mining operations progress, it is necessary first to move the monitor to the location to be mined and then move the feeder/breaker machine to the cooperative position. All of the disconnections, shifting and positioning and recoupling of supply lines and controls must be effected for both apparatuses each time such a change in mining location is made.

With such apparatus, a mining cycle in respect to the utilization of this equipment includes the initial set-up of the apparatus for mining coal from a particular level or section, and when the mining of that section is completed it is necessary to reposition both the monitor and the feeder/breaker upon completion of each cycle. Accumulations of rock and shale about the base of the monitor and the feeder/breaker must be removed. The hydraulic supply line to the monitor must be disconnected. Several sections of the hydraulic supply pipe are removed to enable the supply line to be adjusted to a new position of the monitor. The control position has to be relocated, the air line adjusted, phone line repositioned, etc.

The monitor is moved to the new location, after which the hydraulic supply line is again connected to the monitor. The feeder/breaker must be moved to a corresponding location relative to the monitor. The various controls must be reconnected or set up for operations before the apparatus is again ready for mining. In addition to the foregoing operations which must be performed at each change in the location of the mining operation, the supply line pipe sections must be stacked behind the monitor and the air line must be located accordingly to supply air at each new location, the mine phone line must also be maintained in a position for use and roof arches and planks, as well as flume sections, must be stacked behind the apparatus out of the way of the coal mining and removal operations.

These various steps are repeated at each new mining location as the mining of the coal progresses. With the use of a single monitor separate from the feeder/-breaker, it has been necessary to utilize this sole means first to cut a quantity of coal loose from the seam or panel and then, as a separate step, use this same means to break up the coal that has been cut free from the seam and flush a portion of the broken coal through and by dams onto the feeder/breaker for further reduction in the size of lumps so that the water coal slurry discharged into the flume can move readily to a point where the water is removed and the coal can be prepared for shipment. Since the monitor, for obvious safety reasons, cannot be aimed back toward the entry, the coal accumulated alongside the feeder/breaker was moved by hand onto the breaker.

All of these various operations and the multiple use of the monitor for a plurality of functions necessarily reduced the efficiency of the mining operation and increased the amount of time required to remove a given amount of coal, and additional labor or man hours were involved both in handling the separate monitor and feeder/breaker and the multiple use operation of the monitor and the hand movement of residual coal alongside the feeder/breaker as well as the many steps or functions that were necessary at each relocation of the equipment. Consequently, the total output of the mine not only was reduced but the cost per ton for the coal removed in this manner was increased.

SUMMARY OF THE INVENTION

Contrasted with such prior practices and equipment, the present invention provides a highly efficient system of removing friable carbonaceous material such as coal from a mine hydraulically utilizing a single apparatus for performing all of the functions required from this one piece of equipment which may be moved easily from one mining location to the next as the mining operation progresses. The invention utilizes a feeder/-breaker machine in the entry having a main monitor mounted thereon adjacent to what is referred to herein as the front end of the mining machine. For ease of presentation it will be described in terms of mining coal.

The main monitor on the feeder/breaker machine is mounted for swivelling movements horizontally and vertically. Desirably the horizontal movement is through an arc of approximately 180° and the vertical movement is through an arc of approximately 90°. The mounting of the main monitor 15 is on the front end of the feeder/breaker machine, and preferably is such that it can be disposed in a location on either side of the longitudinal center of the machine, according to the preference in relation to the mining operation, toward the right side of the machine or toward the left side thereof. Alternatively, the monitor may be mounted on the longitudinal center line, whereby it is adaptable to utilization for cutting and removing coal from a mine under any condition that might be encountered. If the monitor is mounted on the right side it is best adapted for mining coal forward and to the left since the loose coal carried by the water will flow onto the unrestricted portion of the feeder, and the risk of coal falling on the monitor is minimized. The reverse is true if the main monitor is mounted to the left center of the feeder/-breaker.

An auxiliary monitor also may be used on the feeder/breaker machine and this monitor is mounted on the feeder/breaker machine rearwardly of the main monitor at a location that might be described as an intermediate position on the machine. The main monitor is utilized primarily to project a high pressure stream of water into a seam, or panel of coal to undercut the seam to cut quantities of coal free from the seam, and to break the large chunks of coal. The auxiliary monitor may be used for any of several purposes. It may be used to assist in breaking up the large chunks of coal that are broken loose from the seam and it may be used to flush broken coal from the side of the feeder into position to be transported by conveyor means on the feeder/-breaker machine through the coal breaker or crushing mechanism on the machine. The coal is crushed and is discharged at the rear end of the machine into a flume provided in the mine floor to conduct a water/coal slurry to apparatus for removing the water and preparing the coal for shipment.

The auxiliary monitor may be mounted for swivelling in both horizontal and vertical directions with the angles of movement a matter of choice. In this regard, it should be recognized that in operation the auxiliary monitor may be, and desirably is, positioned within the entry. The sweep of the monitor will, therefore, be determined by that permissible before the water jet strikes entry roof and wall supports. While the auxiliary monitor may have the same horizontal and vertical movement as the primary monitor it is often desirable to install adjustable stops adjacent the monitor to limit its movement and avoid inadvertent damage to the entry supports or the like. Indeed, if the auxiliary monitor is mounted on one side of the machine, it has been found that entirely satisfactory operation can be obtained with only vertical movement since the monitor will be aimed forwardly alongside the feeder where coal tends to accumulate.

The auxiliary monitor is adapted to be mounted adjacent to either side of the machine or on the longitudinal centerline thereof. If the main monitor is mounted on the right forward portion of the feeder/breaker, the auxiliary monitor is desirably mounted on the left side of the monitor. Conversely, if the main monitor is mounted on the left forward portion of the feeder/-breaker, the auxiliary monitor is desirably mounted on the right side of the monitor. In each of these cases, the auxiliary monitor is best positioned to direct high pressure water against coal that accumulates alongside the feeder portion of the feeder/breaker. One or more boards or dams may be placed on the floor adjacent the feeder to direct water and coal on to the feeder or into the flume.

Both monitors are disposed at an elevation such as to be advantageous in performing their respective functions in that these relatively higher positions enable the projected streams of water to be directed at the coal, both to cut it loose from the seam and to break it up and flush it onto the conveyor mechanism, from the most effective angles. Operation with the base of the main monitor about 3 to 4 feet above the roadway permits ample clearance for coal to pass beneath the monitor. The precise height of either monitor may be varied as desired.

Thus, with the monitors incorporated on the feeder/-breaker machine, all of the mining equipment including monitors, conveying and transporting mechanism, coal breaking and crushing mechanism is mounted on the one apparatus so that as each mining operation is completed by mining out all of the coal in an entry and it becomes necessary to move the equipment to a new location, the move is accomplished at once merely by moving the machine to a new location by means of included winch mechanism. This results in a maximum saying of time lost in making the move and setting up for continued operation, and increases the efficiency of the total mining operation to achieve a maximum reduction in the cost per ton of removing the coal.

After an entry is driven, the feeder/breaker machine is moved into the entry and located at the inner end thereof to start the hydraulic mining operation and continues to mine the coal as it moves rearwardly toward the mouth of the entry. The main monitor on the front end of this feeder/breaker machine mines the coal by undercutting and breaking it loose from the coal seam and breaks it up to some degree while the auxiliary monitor to the rear of the main monitor further breaks up the mined coal on the floor of the entry and flushes coal into position to enter the feeder/breaker machine at the front end thereof. The auxiliary monitor may also be used to remove fallen coal from around the main monitor if the coal begins to restrict the movement of the main monitor. The water pressure at the monitor nozzles generally will be from about 1500 to about 2200 psig and water rates generally will be from about 900 to 1500 gpm for the main monitor and from about 400 to about 700 gpm for the auxiliary monitor. Water rates of about 1000 gpm from the main nozzle and about 500 gpm from the auxiliary nozzle have effectively been employed in mining operations. It will be understood that both water rates and pressures can vary more widely than indicated above depending upon conditions of the deposit.

The nozzle diameter also may be varied. Generally the diameter at the tip will range from about 18 to about 30 mm and for special applications may be as large as 40 mm.

The hydraulic monitor is useful for cutting coal at distances of 40 up to 100 feet and under very favorable conditions even greater distances.

OBJECTS OF THE INVENTION

The primary purpose of this invention is related to a method for the hydraulic mining of friable carbonaceous material from a mine entry, and to a hydraulic mining machine for most efficiently performing all of the functions of the mining operations.

The principal object of the invention is a hydraulic mining apparatus incorporating all of the equipment in a machine for performing the complete operation of hydraulically mining and removing the mined material from the preformed entry.

An important object of the invention is to provide a hydraulic mining machine incorporating a main monitor for cutting friable carbonaceous material from a seam or panel and an auxiliary monitor for breaking up and/or flushing the material into position for transport through the machine.

Another object of the invention is the provision of a hydraulic mining machine having front and intermediate monitors at elevated positions on the machine to provide advantageous angles of attack on a seam and on loosened material in respect to the streams of water issuing from the respective monitors.

Still another object of the invention is to provide a hydraulic mining machine incorporating structure adjacent the front end of the machine for mounting a main monitor thereon and wherein mined material transported on the machine is conveyed on conveying mechanism, passing through the monitor mounting structure below the monitor.

A further object of the invention is the provision of a hydraulic mining machine incorporating a front mounted monitor wherein structure is provided on the machine for mounting the monitor at either side of the longtitudinal centerline of the machine.

A still further object of the invention is to provide a hydraulic mining machine incorporating a front mounted monitor and having a conveyor on the machine for transporting mined material from the front end to breaker mechanism disposed at an intermediate position on the machine and an auxiliary monitor mounted above the breaker mechanism.

A more specific object of the invention is a system of mining coal with a hydraulic mining apparatus wherein all of the hydraulic coal mining functions of cutting the coal and processing thereof to the flume for carrying the coal to a location for final preparation for market are incorporated in a single machine including monitors for cutting the coal and for breaking the coal thus mined and a conveyor on the machine transporting the coal from the front end thereof through breaker mechanism in the machine to a rear discharge into a flume.

DESCRIPTION OF THE DRAWINGS

The foregoing and other and more specific objects of the invention are attained by the mechanism and arrangement illustrated in the accompanying drawings wherein.

DESCRIPTION OF SPECIFIC EMBODIMENT

Figure 1:
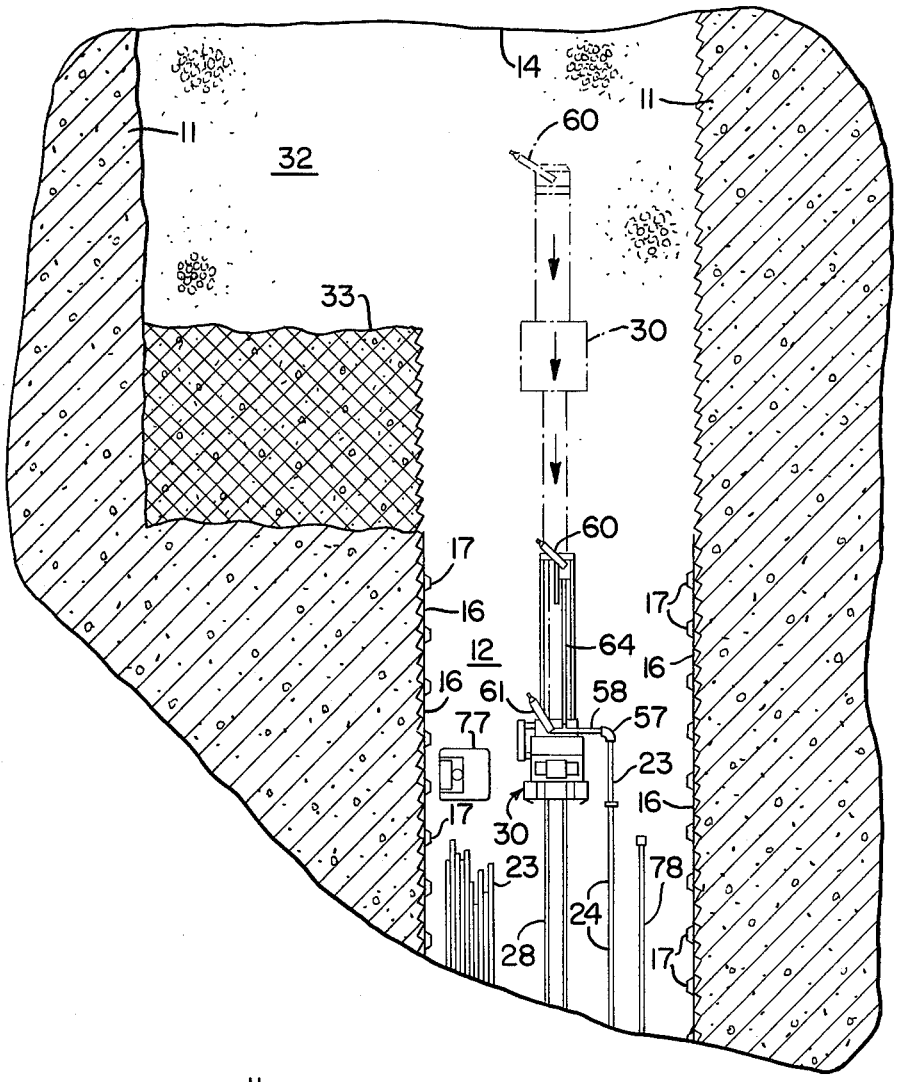
FIG. 1 is a general view in plan indicating the entry completed to its predetermined terminus in the coal bed with a hydraulic mining machine starting the mining operation from adjacent the terminus and moving outwardly of the entry.

In the drawings, referring to FIGS. 1 and 2, the reference 10 represents a roadway in a coal mine and 11 represents a bed of coal which, as shown, is to be mined as hereinafter disclosed. The roadway 10 slopes down hill, as best indicated in FIG. 2. The dimensions and cross-section of an entry may vary widely. The entry may be as wide as 16 feet or more and as high as 10 feet or more.

The entries are progressively lined with wood or metal sheets 16 which are reinforced by beams 17 to provide stability in the entry thus formed. When a sloping (e.g., 7° ± 3°) entry 12 has been completed a hydraulic mining machine is placed in the entry. This hydraulic mining equipment comprises a unitary machine 30 that encompasses all of the functions to be performed in mining and fluming the coal in this single machine. The hydraulic mining is moved into the entry and located adjacent to the terminus 14 where it is placed to start the operation of hydraulically mining the coal bed 11. The machine 30 is shown in dot and dash lines in the entry at a position where an area 32 of the coal bed 11 has been hydraulically mined (See FIG. 1) and then is repositioned as shown in full lines in this figure to mine the coal from another area 33 of the coal bed. The metal sheets 16 and reinforcing beams 17 are systematically removed as the mining operation proceeds in a direction rearwardly of the machine 30 which is moved step by step out of the entry to mine the section of the coal bed 11 at each step that is accessible for mining from each succeeding location of the machine. Movement of the machine in steps of 40 to 70 feet or more is feasible.

Figure 3:
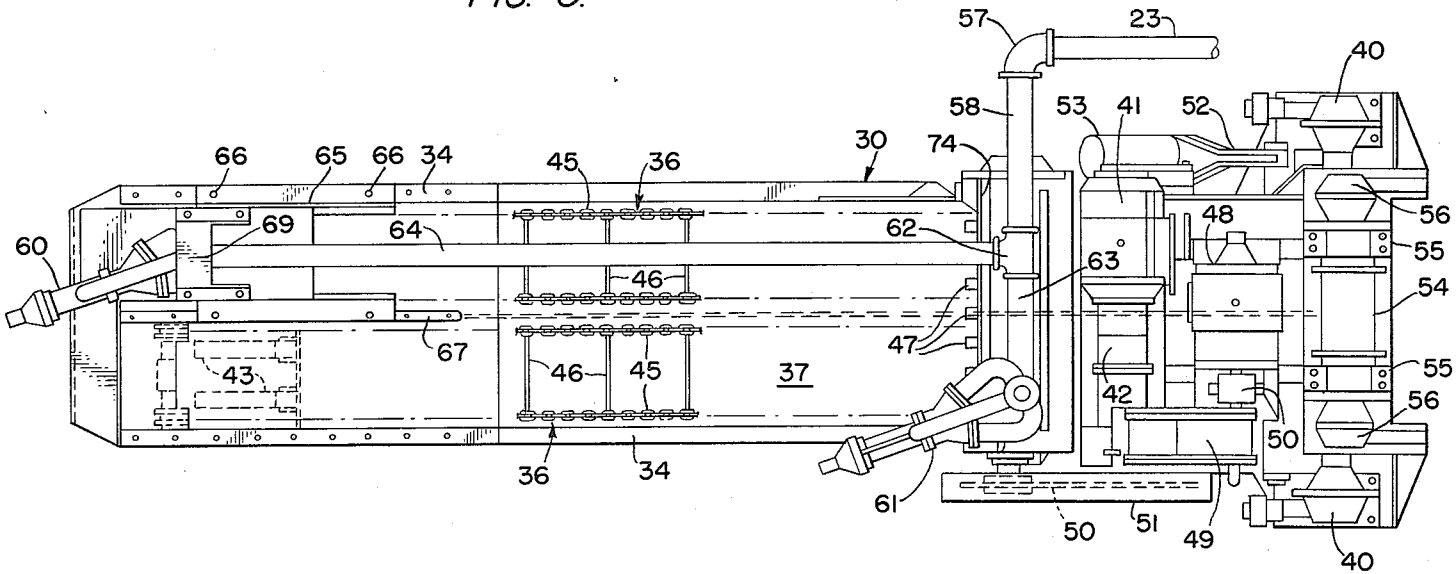
FIG. 3 is a general plan view of a hydraulic mining machine incorporating feeder conveyor mechanism, coal breaker mechanism, longitudinal spaced monitors for mining coal and for breaking and flushing mined coal and power means for the breaker mechanism and for the conveyor mechanism.
Figure 4:
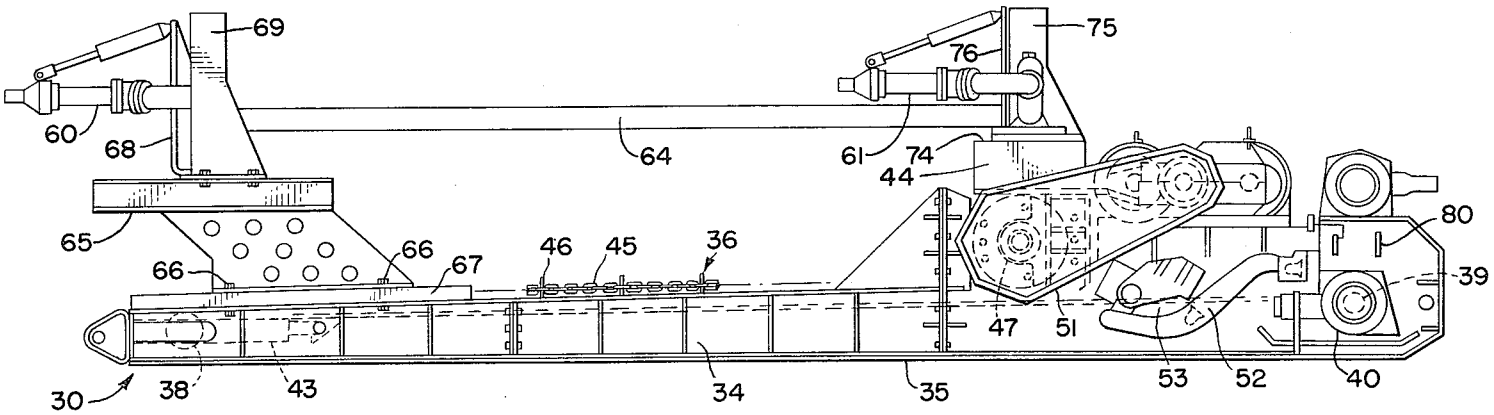
FIG. 4 is a general side elevation view of the hydraulic mining machine.

The hydraulic mining machine 30 is illustrated in greater detail in FIGS. 3 and 4 and includes a frame 34 having a relatively heavier base plate 35 upon which the machine is supported. The machine 30 incorporates conveyor mechanism 36 operating on a supporting plate surface 37 and running around a shaft 38 adjacent the front end of the machine and around an operating shaft 39 at the rear end of the machine. The shaft 39 is driven by variable volume hydraulic motors 40 at opposite ends of the shaft on opposite sides of the machine. A totally enclosed motor 41 drives a variable volume hydraulic pump 42 to power the hydraulic motors 40 with suitable armored hydraulic connections therebetween. The hydraulic pump 42 also powers a plurality of conveyor tensioning cylinders 43 operatively connected with the conveyor shaft 38 at the front end of the machine. An oil reservoir 44 provides a supply of hydraulic oil for the proper functioning of the hydraulic system.

The conveyor mechanism 36 includes continuous chains 45 operating around the front and rear shafts 38 and 39, respectively, and which are disposed in pairs at opposite sides of the center by the machine. The pairs of chains are each connected by vertically disposed plates 46 which function to convey mined coal entering the machine at the front end along the coal supporting plate 37 and feed the coal through a breaker mechanism 47 located at an intermediate position on the machine. The conveyor continues to move the coal rearwardly after leaving the breaker mechanism and discharges the coal at the rear end of the machine. Desirably the coal is broken so that the maximum size of the lumps is generally less than about one-half the width of the flume. Preferably the coal is broken so that the maximum dimension of the larger lumps is less than about 6 inches, and most preferably, less than about 4 inches. It should be understood that some of the coal may be fine and that some pieces may be larger than the sizes discussed above. The flume can handle occasional pieces which have a maximum dimension slightly less than the width of the flume.

The breaker mechanism 47 which reduces the coal to a predetermined lump size is driven by a totally enclosed motor 48 through a speed reducer 49 operatively connected to the breaker mechanism by a gear chain driving mechanism 50 fully enclosed by a watertight guard or housing 51. Floor lift jacks 52, one on each side of the machine, are actuated by hydraulic cylinders 53 which are also powered from the hydraulic pump 42 by means of suitable connections and controls whereby the jacks may be actuated as desired. It should be noted than an overrunning clutch 59 is disposed between the motor 41 and the speed reducer 49 driving the breaker mechanism 47 whereby the motor drives the speed reducer and breaker mechanism in only one direction of rotation and is isolated therefrom in the event of the motor being reversed.

The hydraulic mining machine 30 mines the coal as it moves in a direction outwardly of the entry. This machine is propelled in this reverse direction by a winch and cable mechanism powered also by the means provided on the machine. A variable speed winch 54 is operatively mounted in bearings 55 at the rear of the hydraulic mining machine and is driven by variable volume hydraulic motors 56 powered from the hydraulic pump 42. In operation a cable is operatively mounted for winding and unwinding movement on the which and the free end of the cable is suitably anchored when the machine 30 is initially placed at the terminus 14 of the entry 12. The free end of the cable may be anchored by any suitable means at a location such as to enable the mining machine to be moved by actuation of the winch 54 each time it becomes necessary to move to another mining location until the entry has been completely mined out.

The hydraulic mining machine is completed by the mounting of monitors 60 and 61 thereon which are supplied with high pressure water from the pipe line 23 which has been assembled during the advancement of the continuous mining machine 13 into entry 12. The pipe line 23 is connected with the hydraulic mining machine and the monitors 60 and 61 through an elbow 57 and a laterally disposed relatively short section of pipe 58 which connects with a tee 62 having operative connection with the monitor 61 through pipe section 62 and to the monitor 60 through a pipe 64. While the pipe line 23 is shown on the right side of the machine in FIG. 3, (the same side as the main monitor) it is generally preferable to place the water line on the side opposite the main monitor so that the machine may be located closer to the side of the entry. The monitors 60 and 61 are swivelly mounted for rotative movement in a horizontal plane and are also movable vertically whereby the monitors are universally movable for directing the high pressure stream of water issuing from the respective monitors in any direction desired within the range of movement permitted by the mounting of the monitors on the mining machine. While not shown a valve is desirably located in the lines to each monitor to permit ready control of the volume of water to each monitor.

The monitor 60 is mounted adjacent to the front end of the machine and is utilized to mine the coal and break it loose from the bed 11 so that it is deposited on the floor of the entry and the monitor 61 then breaks up the coal on the floor to a greater extent than the conditions in which it is broken from the coal bed and/or flushes the broken coal on the floor into position to enter the front end of the machine 30 and be picked up by the conveyor 36 and transported through the breaker mechanism 47 and discharge it at the rear end of the machine into the flume 28. The water from both of the monitors mixes with the broken coal to form a coal/water slurry which facilitates its being conveyed through the mining machine and its transport in the flume 28. Generally, the coal/water slurry will have a coal:water ratio of about 1:4 to about 1:0.5.

Figure 5:
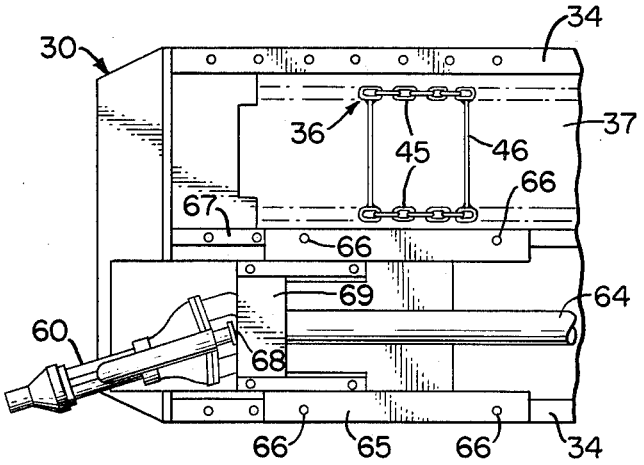
FIG. 5 is a fragmentary top plan view of the front end portion of the hydraulic mining machine illustrating a monitor mounting arrangement whereby the monitor may be mounted on one side or the other of the machine.

The front mounted monitor 60 is positioned relatively high on the mining machine whereby the coal/water slurry picked up by the conveyor 36 passes beneath and beside the monitor as it progresses toward the breaker 47 as shown in FIGS. 3, 4 and 5, this monitor may be located on the machine at either side of the longitudinal center line of the machine and is supported on a frame structure 65 that is removably mounted at one side frame 34, as by bolts 66, and at the center line of the machine on center support 67 also by bolts 66. The frame structure 65 is of open construction for the passage of the coal/water slurry therethrough as it is carried through the machine by the conveyor 36. The disposition of the monitor 60 for support on the structure 65 includes a swivelling mounting bracket 68 and a protective framework 69 secured to the structure 65, preferably by bolts, whereby it can be removed when necessary. A rack and pinion gear in the base structure actuated by a hydraulic cylinder may be employed to cause bracket 68 to swivel and the vertical movement of the monitor can be effected with a hydraulic cylinder. Although the hydraylic cylinder is shown mounted over the monitor, it is preferable to mount the cylinder to the rear of the monitor between the back of the monitor and the base to provide maximum protection from falling coal.

As best revealed by a comparison of the disposition of the monitor 60 in FIGS. 3 and 5, it will be seen that this monitor can be mounted to either side of the longitudinal center line of the hydraulic mining machine. In FIG. 3 the monitor is shown as located on one side of the machine, while FIG. 5 depicts the monitor as located on the opposite side of the machine. Wither mounting position is equally effective for hydraulically mining coal from the coal bed 11 in the mine, depending upon which side of the machine the coal is being mined from.

Figure 6:
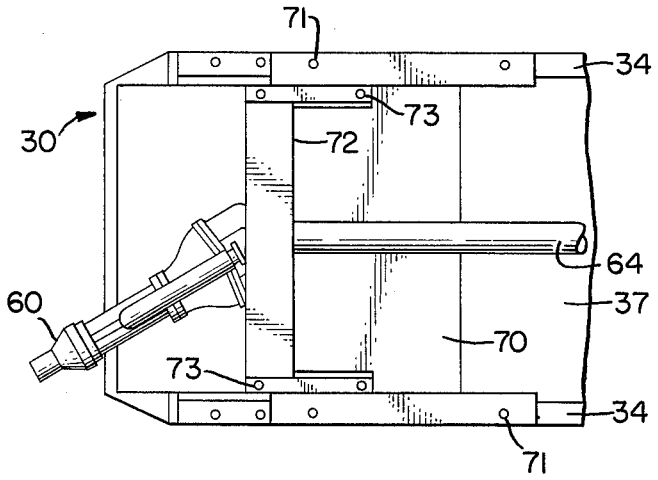
FIG. 6 also is a fragmentary top plan view of the front end portion of a hydraulic mining machine illustrating a modified form of mounting arrangement for the front monitor whereby the monitor is mounted generally on the longitudinal centerline of the machine.
Figure 7:
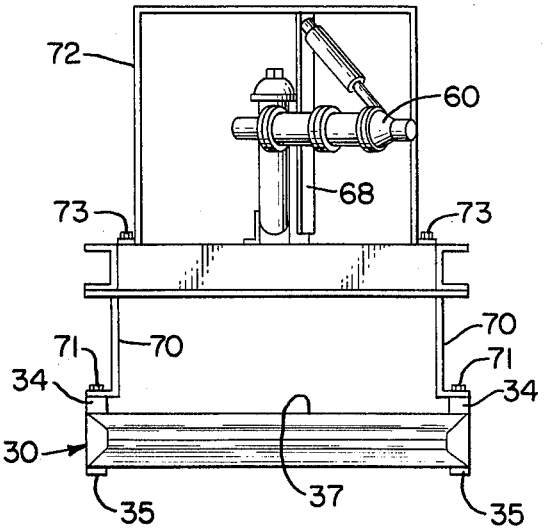
FIG. 7 is an elevational view of the front end of the machine showing the centrally located monitor.

As shown in FIGS. 6 and 7, provision is also made for disposing the front monitor 60 on the longitudinal center line of the mining machine where it is equally effective in mining coal at either side of the machine. In this arrangement the supporting frame structure 70 bridges the full width of the mining machine from one side frame 34 to the other and is removably secured thereon by bolts 71. The similarly wider protective frame structure 72 is removably mounted on the supporting frame 70 by means of bolts 73.

The main monitor 60 is located at the front of the mining machine and the secondary or auxiliary monitor 61 is located rearwardly of the front mounted monitor at an intermediate position on the machine. This auxiliary monitor also is mounted at a relatively high position on the machine to obtain a more effective angle of attack on the coal similar to that obtained by the elevated position of the front monitor. The monitor 61 is mounted on suitable supporting structure 74 over the oil reservoir 44 and which is such as to enable this monitor also to be shifted to one side or the other of the mining machine to work on the mined coal on the floor of the entry 12 from the most effective position, depending upon the side of the machine from which the coal is being mined. The monitor is shielded by a protective frame structure 75 and the mounting includes a swivelling bracket 76 similar to that used with the front mounted monitor 60 so that both monitors are operable in a similar manner.

Figure 2:
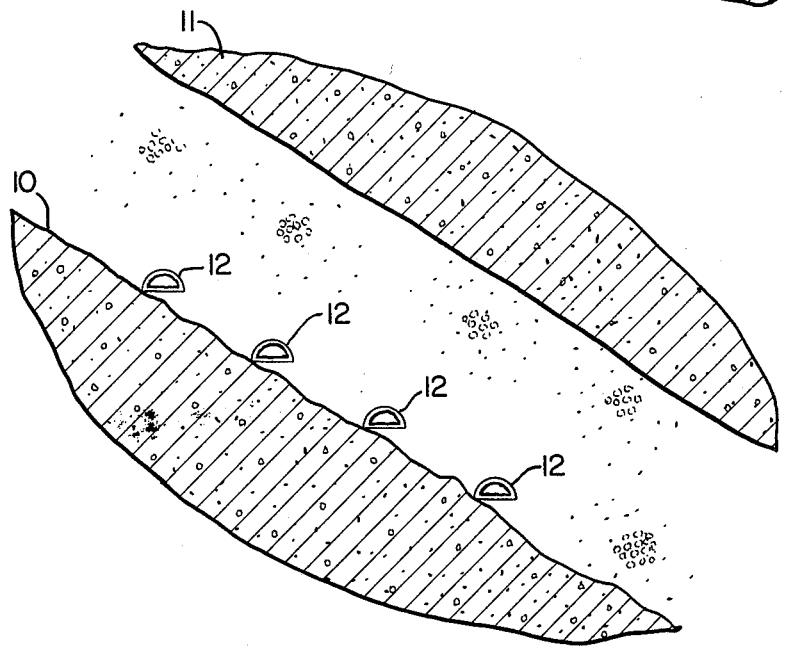
FIG. 2 is a vertical sectional view through the roadway of a coal mine showing the location of several entries into the bed of coal from the roadway.

As best indicated in FIG. 1, the mining machine 30 may be controlled and operated remotely as from a position 77 at one side of the entry 12 and which is relocated as the mining operation proceeds and the machine progresses rearwardly out of the entry. The position 77 may include full controls for all of the functioning devices on the mining machine with electric lines, telephone, etc. The high pressure water line 23 is disassembled as necessary at each relocation of the mining machine as it is moved rearwardly by the winch 54 in accordance with the progressive mining of the coal bed and reassembled at each step-by-step retreat out of the entry. The pipe sections 23 are stacked up behind the control position 77 as this operation continues. An air line 78 supplies air into the entry and is similarly shortened to the new mining locations as the machine 30 is shifted rearwardly of the entry. Hand controls 80 are provided also on the machine adjacent to the rear end thereof on one side frame 34 and may be duplicated on the opposite side thereof if desired.

From the foregoing it will be seen that a system of mining coal has been provided wherein a single piece of hydraulic mining equipment is employed. This equipment comprises a machine having a front end main monitor for hydraulically mining coal from the coal bed as the machine is moved rearwardly in the entry and an intermediate auxiliary monitor for breaking up mined coal on the entry floor and flushing it into position to be picked up at the front end of the mining machine and conveyed through breaker mechanism on the machine. The crushed coal is discharged at the rear end of the machine into the flume for transport out of the entry as a coal/water slurry with all of the functions of the hydraulic mining machine being performed as the machine progresses out of the entry starting from the terminus.

While the above description is couched primarily in terms of coal it should be understood that friable carbonaceous material (e.g., tar sands, gilsonite and other suitable material) which break up under the impact of hydraulic streams are generically contemplated. Moreover, although a single main monitor and a single auxiliary monitor is discussed, the use of more than one main or auxiliary monitors is also contemplated.

I claim:

1. An apparatus for hydraulically mining friable carbonaceous material comprising a machine having a breaking mechanism, conveyor mechanism on the machine for transporting mined material fron an end of the machine through said breaking mechanism to the opposite end of the machine for discharge, power means on the machine for driving said mechanisms, a main monitor mounted on the machine for cutting carbonaceous material from a working face and an auxiliary monitor mounted on the machine for substantially exclusively breaking larger pieces of cut carbonaceous material and for flushing broken carbonaceous material toward said conveyor mechanism, said main monitor being mounted adjacent said first named end of the machine and said auxiliary monitor being longitudinally displaced from said main monitor and being mounted intermediate of ends of said machine.

2. An apparatus as set forth in claim 1 wherein said main and auxiliary monitors are secured on a supporting structure mounting the monitors in spaced relation above said conveyor mechanism.

3. An apparatus as set forth in claim 1 wherein said auxiliary monitor is mounted on the machine over said breaking mechanism.

4. An apparatus as set forth in claim 2 wherein said supporting structure is mounted on said machine at opposite sides thereof and includes an opening therethrough for passage of mined material transported by said conveyor mechanism.

5. An apparatus as set forth in claim 1 wherein said machine includes means for moving the machine from one mining location to another, and said means for moving the machine is powered from said power means on the machine.

6. An apparatus as set forth in claim 1 wherein said main monitor is positioned to one side of the longitudinal centerline of the machine and said auxiliary monitor is positioned on the other side of said longitudinal centerline.

7. The apparatus of claim 1 wherein said conveying mechanism comprises at least two parallel conveyors separated by a structural member at the longitudinal center line of the apparatus and said main monitor is supported by means mounted on the machine at one side thereof and on said central structural member.

8. The apparatus of claim 7 including means whereby said main monitor can be supported on said central structural member and on either side of said machine.

9. The method of mining friable carbonaceous material which comprises:

(a) establishing a sloping entry in a bed from a mine roadway to a predetermined terminus;

(b) positioning a hydraulic mining machine in the entry adjacent to said terminus, said machine including a breaking mechanism, a conveyor mechanism for transporting mined material from an end of the machine through said breaking mechanism to the opposite end of the machine for discharge, a main monitor mounted on the machine adjacent to said first named end, and an auxiliary monitor mounted on said machine, said auxiliary monitor being longitudinally displaced from said main monitor and being positioned intermediate said ends, said hydraulic mining machine being positioned so that said auxiliary monitor is within said entry;

(c) hydraulically cutting and breaking material from the working face of said entry with said main monitor mounted on said machine;

(d) employing said auxiliary monitor substantially exclusively for breaking material mined by said main monitor and flushing the mined material into position to enter the hydraulic mining machine;

(e) transporting said material on the conveyor mechanism of said machine through said breaking mechanism; and (f) conveying the crushed material out of said entry as a solids/water slurry in a sloping flume.

10. The method as defined in claim 9 wherein said friable carbonaceous material is coal.

* * * * *